US007789713B2

(12) United States Patent
Slepov

(10) Patent No.: US 7,789,713 B2
(45) Date of Patent: Sep. 7, 2010

(54) CONNECTOR JACK WITH REDUCED HOST PCB FOOTPRINT, ASSEMBLY THEREOF AND FABRICATION METHOD OF THE SAME

(75) Inventor: Dmitry Slepov, Taipei (TW)

(73) Assignee: Tibbo Technology, Inc., Taipei (TW)

( * ) Notice: Subject to any disclaimer, the term of this patent is extended or adjusted under 35 U.S.C. 154(b) by 0 days.

(21) Appl. No.: 12/144,914

(22) Filed: Jun. 24, 2008

(65) Prior Publication Data

US 2009/0318015 A1 Dec. 24, 2009

(51) Int. Cl.
*H01R 24/00* (2006.01)

(52) U.S. Cl. ..... 439/676

(58) Field of Classification Search ..... 439/676, 439/490; 29/874; 340/815
See application file for complete search history.

(56) References Cited

U.S. PATENT DOCUMENTS

| | | | | |
|---|---|---|---|---|
| 4,497,526 | A | 2/1985 | Myers | |
| 4,978,317 | A | 12/1990 | Pocrass | |
| 5,378,172 | A | 1/1995 | Roberts | |
| 5,587,884 | A | 12/1996 | Raman | |
| 5,613,873 | A | 3/1997 | Bell, Jr. | |
| 5,685,737 | A | 11/1997 | Morin et al. | |
| 5,741,152 | A | 4/1998 | Boutros et al. | |
| 5,790,041 | A * | 8/1998 | Lee | 340/815.45 |
| 5,876,239 | A | 3/1999 | Morin et al. | |
| 5,885,100 | A | 3/1999 | Talend et al. | |
| 5,915,993 | A | 6/1999 | Belopolsky et al. | |
| 6,171,152 | B1 | 1/2001 | Kunz | |
| 6,190,210 | B1 | 2/2001 | Belopolsky et al. | |
| 6,224,417 | B1 * | 5/2001 | Belopolsky et al. | 439/490 |
| 6,241,550 | B1 * | 6/2001 | Laity et al. | 439/490 |
| 6,334,787 | B1 * | 1/2002 | Chang | 439/490 |
| 6,431,906 | B1 | 8/2002 | Belopolsky | |
| 6,881,096 | B2 | 4/2005 | Brown et al. | |
| 2005/0106941 | A1 * | 5/2005 | Witchey | 439/620 |
| 2005/0136731 | A1 * | 6/2005 | Brown et al. | 439/490 |
| 2005/0181643 | A1 * | 8/2005 | Brower et al. | 439/76.1 |

* cited by examiner

*Primary Examiner*—Alexander Gilman
(74) *Attorney, Agent, or Firm*—Tim Tingkang Xia; Morris, Manning & Martin LLP

(57) ABSTRACT

A connector jack with reduced host PCB footprint and an assembly of the same are provided. The provided connector jack is constructed based on a housing defining at least a front face with a plug receiving cavity on the surface thereof and with a plurality of electrical contacts positioned within the cavity, and a bottom face having a recess area on the surface thereof and adapted for mounting on a circuit board. In the present invention, at least a portion of the housing is made of a transparent or translucent material so that the status indicators located within the recess will be visible through the transparent portion of the front face of the jack housing, and the recess area occupies a substantial portion of the bottom face and allows to place additional components on the circuit board at least partially within the recess area.

10 Claims, 5 Drawing Sheets

CONNECTOR JACK WITH REDUCED HOST PCB FOOTPRINT, ASSEMBLY THEREOF AND FABRICATION METHOD OF THE SAME

FIELD OF THE INVENTION

The present invention relates to connector jacks, connector jack assemblies and the fabrication method thereof. More particularly, the present invention relates to an improved connector jack with reduced effective host circuit board footprint, assemblies adopting such connector jack and the fabrication method thereof.

BACKGROUND OF THE INVENTION

RJ connectors are commonly used in telecommunications and data networking equipment. Such connectors are typically employed for electrical connection between two communication devices. For example, RJ45 connectors are standard for interconnecting Ethernet devices.

RJ connectors employ a male connector plug and a female connector jack. The present invention concerns an improved female connector jack and a connectorjack assembly.

A connector jack, such as the one shown on FIG. 1, characteristically is constructed by a generally rectangular dielectric housing 11, the dielectric housing having a front face 12 with a receptacle 18 for receiving the male connector plug (not shown), and a bottom face 13 adapted for mounting on the circuit board (not shown). The circuit board upon which the jack is physically mounted will herein be referred to as the host circuit board.

The mounting means provided for mounting the jack on the host circuit board typically include two mounting pins 19 for insertion into the corresponding holes on the host circuit board.

The dielectric housing typically also defines a left face 14, a right face 15, a top face 16, and a rear face 17.

The receptacle 18 on the front face 12 of the dielectric housing 11 includes a cavity 20 that is shaped and dimensioned to mate with the male connector plug. Positioned inside the cavity are electrical contacts 21 for mating with the electrical contacts of the plug. These contacts are typically spring contacts for biased engagement with the plug.

The bottom face 13 of the jack also has pins or leads 22 protruding from the bottom face towards the host circuit board. These pins or leads conduct electrical signals between the jack and the host circuit board. These pins or leads may include a direct extension of the spring contacts 21, or be independent from the spring contacts. T he pins or leads 22 can be shaped for thru-hole or surface mounting to the host circuit board. In many commercially available jacks, pins 22 alternatively protrude from the rear face 17 of the jack.

Many connector jacks have internal chambers (not shown) that house additional electronic components, such as signal conditioning components, electrostatic discharge (ESD) protection components, power-over-Ethernet components, and any other necessary circuits.

Some, but not all connector jacks have a shield 23. The typical shield is stamped out of sheet metal and formed as to envelope the dielectric housing 11 of the jack. Typically, the shield 23 also has solder tails 24 by which the shield is grounded to the host circuit board. Solder tails 24 also perform the function of securing the jack on the host circuit board.

The male connector plug and jack also incorporate a latching mechanism for reliable engagement with each other. This mechanism consists of a latching shoulder on the plug (not shown) and corresponding latching shoulders 25 on the connector jack. T he latching shoulders on the jack are located on the front face 12 and in the proximity to the bottom face 13 of the jack.

The use of the latching mechanism for reliable mating of the male plug with the female jack constitutes one of the best design elements of RJ connectors. This latching mechanism, however, also increases the height of the jack as it extends downwards from the plug-receiving cavity 20 on the front face 18 of the jack.

Continuous miniaturization of electronic devices demands an ever-increasing density of component placement on printed circuit boards and miniaturization of electronic components. While most electronic parts used in modern circuit board assemblies have shrunk dramatically in size, the connector jack has remained essentially unchanged, with its outline dimensions dictated mainly by the size of the connector plug and the corresponding receptacle cavity on the jack combined with the space occupied by the latching mechanism of the jack.

Several attempts has been made to somewhat decrease the overall dimensions of the connector jack. Most of these attempts have concentrated on decreasing jack height. F or example, U.S. Pat. No. 4,497,526 discloses a jack of reduced height, and the height reduction is achieved by moving the latching mechanism off the jack and onto the bottom side of the housing of the electronic device in which the jack is installed.

U.S. Pat. No. 5,378,172 discloses a low-profile jack, in which the reduction in the jack height is achieved by delegating the latching function of the jack to the host circuit board.

U.S. Pat. No. 6,190,210 also discloses a low-profile jack, where the height of the jack is reduced by dividing the latching function of the jack between the jack itself and the host circuit board.

The above inventions have only managed to reduce the height of the jack, and even the reduction in height was not dramatic. The length and width of the jack, and hence, the space occupied by the jack on the host circuit board, have remained essentially the same.

Unable to decrease the jack size further, inventors and manufacturers have attempted to add functionality to the jack in order to better utilize the space occupied by this component on the host circuit board.

One popular improvement was to add status indicators, such as light emitting diodes (LEDs), and numerous patents exist on the subject. Many such inventions incorporate complex light tubes, guides, separate lenses, and other means by which the light from the light source is delivered to the front face of the jack.

Majority of the inventions place the status indicators, or areas through which the light exits through the front face of the jack, to the left and to the right of the latching mechanism of the jack. U.S. Pat. Nos. 5,613,873, 5,685,737, 5,741,152, 5,876,239, 5,915,993, 6,224,417, 6,334,787, and 6,431,906 all disclose such jack designs.

Some inventors have also added the status indicators, or areas through which the light exits through the front face of the jack, to the portion of the jack, opposite to the latching mechanism and in the area proximal to the top face of the jack. Examples of such jack designs can be found in the U.S. Pat. Nos. 4,978,317 and 5,885,100.

It is noteworthy that despite a variety of disclosed approaches, the above patents only anticipated a rather limited number of status indicators provided per each jack—typically no more than two. At the same time, the increase in complexity and sophistication of modern electronic devices demands that more status indicators are implemented and it is not uncommon to have devices that require four or more of such status indicators to be provided. For example, a miniature electronic device, barely larger than the jack it encompasses, may require one status light to indicate a network link status, another light to indicate the type of the link (10BaseT or 100BaseT), as well as two additional lights to indicate the operating mode of the device itself.

Providing signal conditioning components within the jack housing is another popular method of extending jack functionality and justifying the host board space occupied by the jack. Examples of such inventions can be found in the U.S. Pat. Nos. 5,587,884 and 6,171,152.

Jacks with integrated isolation and filtering components, known as "jacks with magnetics", are currently commonplace. Many related patents claim to integrate magnetics into the jack while maintaining essentially the same host circuit board footprint as that of a simple jack with no magnetics.

Ironically, in real life, integrating conditioning components within the jack has led to an increase in average jack size and, consequently, the footprint occupied by the jack on the host circuit board. This is because these components must be able to withstand significant levels of ESD and high common-mode voltages. T his prevents the miniaturization of such components. More recently, power-over-Ethernet circuits have also been integrated into some jacks, thus further increasing the area occupied by such jacks on the host circuit boards.

Finally, some inventors have even integrated data processing capabilities into the jack. For example, U.S. Pat. No. 6,881,096 discloses a jack that integrates not only magnetics, but also a processor, Ethernet controller, memory, and other computing components within a jack. Needless to say that such increase in jack functionality has led to the enlargement of the jack and its corresponding footprint on the host circuit board.

Thus, while integrating more functional elements within the jack, the above inventions also increase the space occupied by the jack on the host circuit board and, hence, decrease the host circuit board space available to other electronic components.

SUMMARY OF THE INVENTION

In view of the above, it is an object of the present invention to reduce the effective footprint of the connector jack on the host circuit board and maximize the useful host circuit board area on which other electronic components can be mounted, while preserving sufficient space within the jack for placement of additional functional components such as signal conditioning circuitry, ESD protection circuitry, power-over-Ethernet circuitry, and even intelligent data processing circuitry.

It is another object of the present invention to provide for an increased number of distinct status indicators that can be mounted on the host circuit board together with the jack, without leading to the increase of the required host circuit board size.

It is yet another object of the present invention to simplify the construction of the jack and avoid the use of light tubes, guides, separate lenses, and other complex means of delivering the light from the status light sources to the front face of the jack.

It is still another object of the present invention to provide a connector jack assembly constructed in a way that reduces the footprint occupied by the connector jack assembly on the host circuit board, maximizes the useful host circuit board space, provides for an increased number of status indicators that can be mounted on the host circuit board together with the connector jack assembly and in a way that would not lead to the increase in the required host circuit board size, while at the same time avoiding the use of light tubes, guides, separate lenses, and other complex means of delivering the light from the status light sources to the front of the connector jack assembly.

In a preferred embodiment of the present invention, the dielectric housing of the connector jack incorporates a large recess area on the bottom face thereof. The recess area is generally rectangular in shape and almost as large as the footprint of the jack, with only relatively thin walls extending downwards along at least three sides of the recess area. Preferably, these walls extend downwards along the front, right, and left faces of the jack. It is contemplated that other electronic components, such as a microcontroller, may be mounted on the host circuit board at least partially within this recess area, thus increasing the host circuit board space utilization.

In a preferred embodiment of the present invention, the lower portion of the jack housing including the bottom face and three walls forming the recess area on the bottom face, is made of a transparent or translucent material, thus making it possible to mount a number of status indicators, such as LEDs, on the host circuit board and within the recess area. Thus mounted, the status indicators will be visible through the transparent portion of the front face of the jack housing. Taking into the account miniature dimensions of modern LEDs, it becomes obvious that a large number of such LEDs can be mounted on the host circuit board within the recess area.

In a preferred embodiment of the present invention, the pins or leads of the jack extend towards the host circuit board, the pins or leads conducting electrical signals between the jack and the host circuit board. In the preferred embodiment of the present invention, these pins or leads are shaped for thru-hole mounting to the host circuit board. It is contemplated, however, that pins or leads for surface mounting to the host circuit board can be used without deviating from the spirit and the scope of the present invention.

It is additionally contemplated that the relative size or volume of the transparent or translucent portion of the jack housing and the size or volume of the remaining portion of the jack housing can vary depending on the design of the jack. Additionally, the non-transparent portion of the jack housing needs not be monolithic and may be constructed from several elements. It should be noted and understood that all such variations are encompassed within the spirit and the scope of the present invention.

It is also contemplated, that the jack of the present invention can incorporate any additional circuitry such as signal conditioning components, ESD protection components, power-over-Ethernet components, and even data processing components such as a microcontroller, Ethernet controller, data memory and the like.

In an alternative embodiment of the present invention, the pins or leads of the RJ jack do not extend towards the host circuit board. Preferably, there is an additional circuit board that at least partially resides in the recess area on the bottom face of the jack and between the host circuit board and the jack body. In this embodiment, the pins or leads of the connector jack extend towards this additional circuit board. T he additional circuit board then has its own set of pins or leads extending towards the host circuit board, the pins or leads carrying electric signals between the additional circuit board and the host circuit board.

It is contemplated that the additional circuit board can have a number of status indicators, such as LEDs, mounted upon it and within the recess area on the bottom face of the connector jack. Thus mounted, the status indicators will be visible through the transparent portion of the front face of the jack housing. Taking into the account miniature dimensions of modern LEDs, it becomes obvious that a large number of such LEDs can be mounted on the additional circuit board within the recess area.

The additional circuit board may also carry any required electronic components including but not limited to signal conditioning circuitry, ESD protection circuitry, power-over-Ethernet circuitry, and even data processing components such as a microcontroller, Ethernet controller, data memory and the like.

In a preferred embodiment of the present invention, a connector jack assembly including a circuit board defining top and bottom sides, a first part mounted upon the top side of the circuit board, and a second part mounted upon the bottom side of the circuit board is constructed. It should be understood that the terms top and bottom are used here for clarity and should not be construed as limiting the scope of the present invention in any way.

The second part includes a generally rectangular body defining a front face, a bottom face, as well as top, left, right and rear faces.

The front face of the second part incorporates a latching mechanism for the male plug. Together with the first part, the second part forms a complete receptacle for the male plug.

The bottom face of the second part is adapted for mounting on the host circuit board. Thus, the entire connector jack assembly is mounted on the host circuit board by using the mounting means provided on the bottom face of the second part.

The bottom face of the second part also incorporates a large recess area. The recess area is generally rectangular in shape and almost as large as the footprint of the second part, with only relatively thin walls extending downwards along at least three sides of the second part. In the third embodiment of the present invention, these walls extend downwards along the front, right, and left faces of the second part. It is contemplated that other electronic components, such as a microcontroller, may be mounted on the host circuit board at least partially within this recess area, thus increasing the host circuit board space utilization.

The second part is molded from a transparent or translucent material, in which case it becomes possible to mount a number of status indicators, such as LEDs, on the host circuit board and within the recess area. Thus mounted, the status indicators will be visible through the front face of the second part. Taking into the account miniature dimensions of modern LEDs, it becomes obvious that a large number of such LEDs can be mounted on the host circuit board within the recess area.

The connector jack assembly according to the preferred embodiment of the present invention also has pins or leads that extend towards the host circuit board, the pins or leads conducting electrical signals between the connector jack assembly and the host circuit board. In this embodiment, these pins or leads are shaped for through-hole mounting to the host circuit board. It is contemplated, however, that pins or leads for surface mounting to the host circuit board can be used without deviating from the spirit and the scope of the present invention.

It is additionally contemplated, that the circuit board of the connector jack assembly can have a significant size and a multitude of additional components can be placed on this circuit board. Such additional components may include signal conditioning components, ESD protection components, power-over-Ethernet components, and even data processing components such as a microcontroller, Ethernet controller, data memory and the like.

In a further preferred embodiment of the present invention, the pins or leads of the circuit board of the connector jack assembly do not extend towards the host circuit board. In the fourth embodiment of the present invention, there is an additional circuit board that partially resides in the recess area on the bottom face of the second part and between the host circuit board and the second part. Preferably, the pins or leads of the circuit board extend towards this additional circuit board. The additional circuit board then has its own set of pins or leads extending towards the host circuit board, the pins or leads carrying electric signals between the additional circuit board and the host circuit board.

It is contemplated that the additional circuit board can have a number of status indicators, such as LEDs, mounted upon it and within the recess area on the bottom face of the second part. Thus mounted, the status indicators will be visible through the transparent or translucent material of the second part. Taking into the account miniature dimensions of modern LEDs, it becomes obvious that a large number of such LEDs can be mounted on the additional circuit board within the recess area.

The additional circuit board may also carry any required electronic components such as signal conditioning components, ESD protection components, power-over-Ethernet components, and even data processing components such as a microcontroller, Ethernet controller, data memory and the like.

The foregoing and other features and advantages of the present invention will be more clearly understood through the following descriptions with reference to the drawings, wherein:

DETAILED DESCRIPTION OF THE PREFERRED EMBODIMENT

In the following detailed description, reference is made to the accompanying drawings that form a part thereof, and in which are shown by way of illustration, specific embodiments in which the invention may be practiced.

The embodiments of the present invention are described in sufficient detail to enable those skilled in the art to practice the invention, and it is to be understood that other embodiments may be utilized. It is also to be understood that changes can be made without departing from the spirit and scope of the present invention. The following detailed description, therefore, is not to be taken in the limiting manner, and the scope of the present invention is defined by the following claims and their equivalents.

Figure 1:
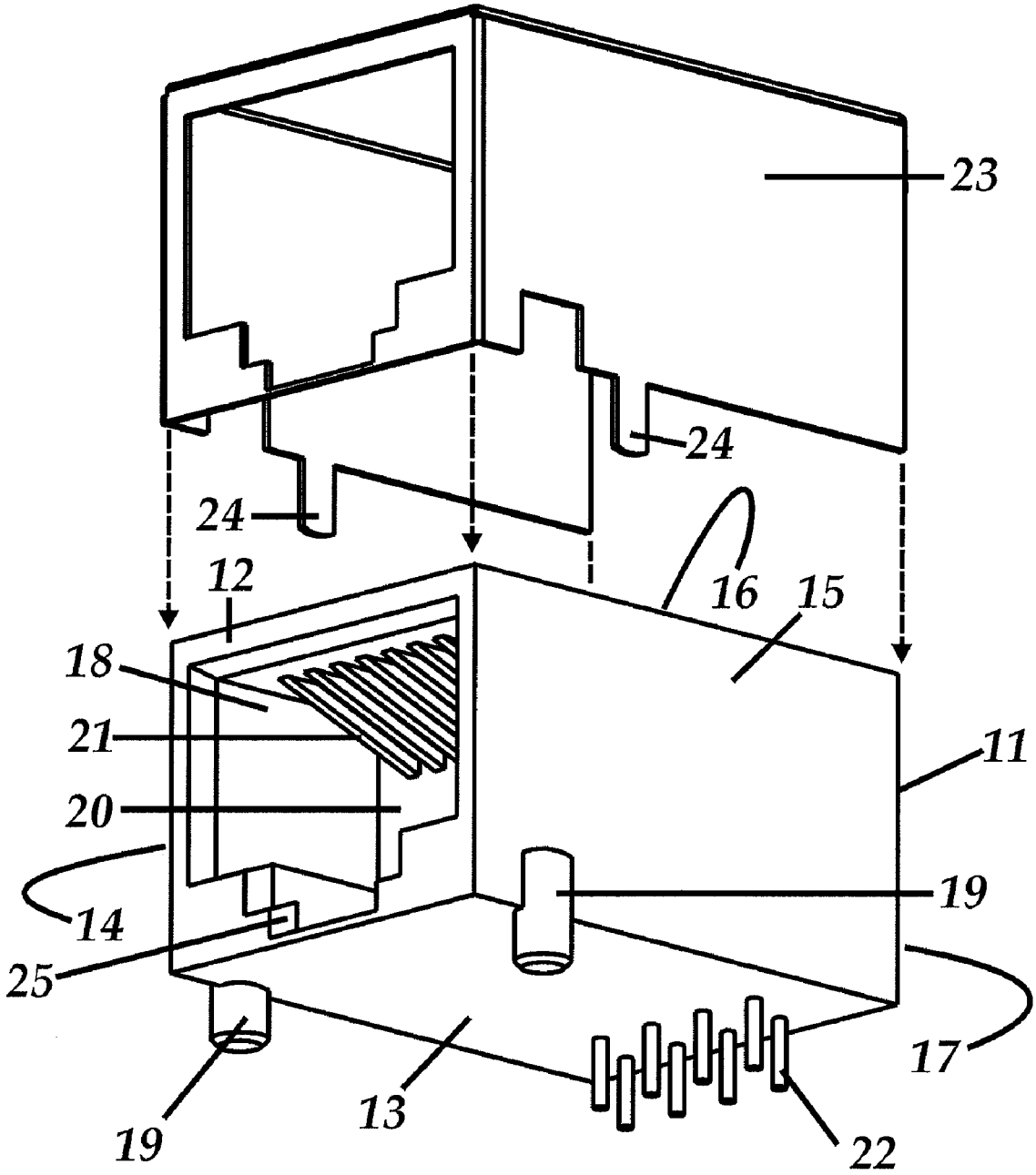
FIG. 1 PRIOR ART
FIG. 1 is a diagram showing a construction of a conventional connector jack according to the prior art.
Figure 2:
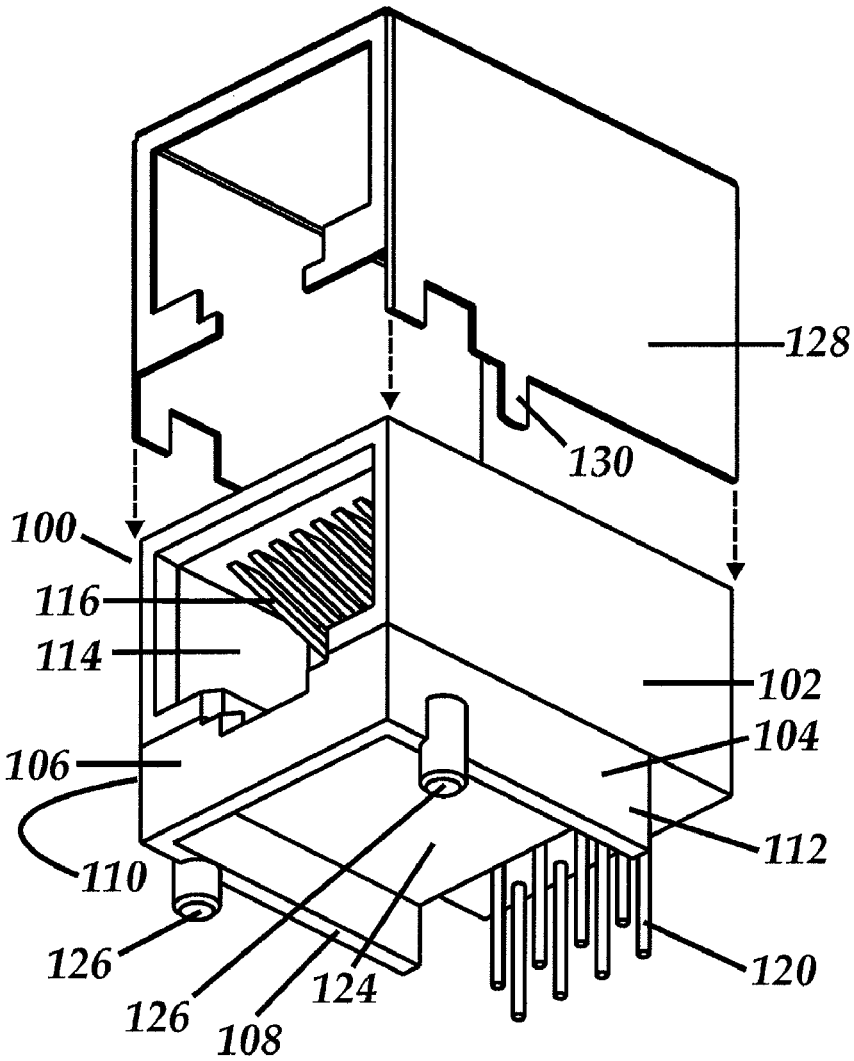
FIG. 2 is a perspective view of a connector jack according to a first preferred embodiment of the present invention with the shield separated from the rest of the jack.
Figure 3:
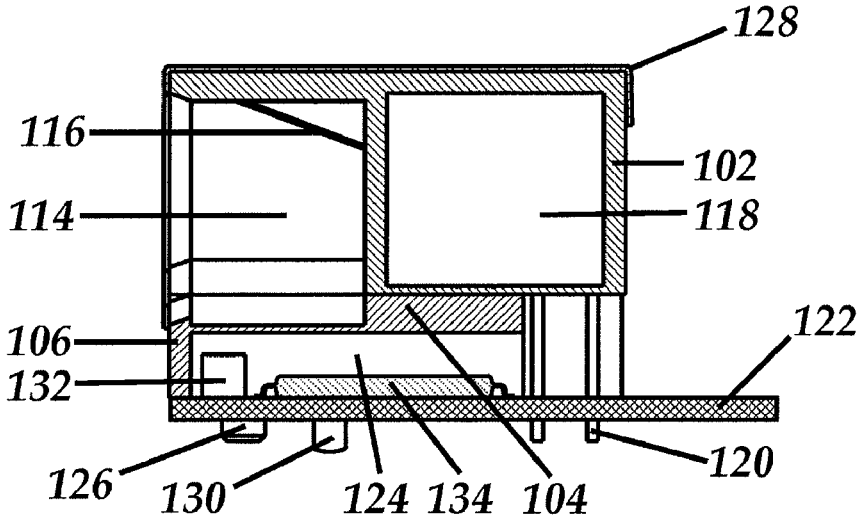
FIG. 3 is a cross-sectional view of a connector jack according to the first preferred embodiment of the present invention, and a host circuit board with a status indicator and an IC chip installed on this host circuit board.

Referring particularly to FIGS. 2 and 3 showing a first preferred embodiment of the present invention. FIG. 2 is a perspective view of a connector jack according to the first preferred embodiment of the present invention, with the shield separated from the rest of the jack. FIG. 3 is a cross-sectional view of the connector jack according to the first preferred embodiment of the present invention, and a host circuit board with a status indicator and an IC chip installed on this host circuit board.

As shown in FIGS. 2 and 3, the dielectric body of the connector jack 100 is formed from two dielectric parts 102 and 104. The parts 102 and 104 are arranged in such a way that the part 102 is stacked on top of the part 104.

Dielectric part 102 is formed from any suitable material conventionally used in the manufacture of connector jacks, such as an appropriate mixture of the ABS and PC plastics. It should be noted that the part 102 is shown herein in a simplified form and, in fact, may consist of several separately molded parts. Such details are irrelevant to the essence of the present invention and are not shown for clarity.

Dielectric part 104 is formed from any suitable transparent or translucent material, such as ABS. The part 104 defines a generally rectangular outline shape that characteristically includes a front face 106, a bottom face 108, a left face 110, and a right face 112. Furthermore, the bottom face 108 defines a generally rectangular recess area 124 formed by wall extensions of the front face 106, the left face 110, and the right face 112. The footprint of the jack 100 on the host circuit board 122 is then effectively defined by the area occupied by the three thin walls.

Additionally, the part 104 features two mounting pins 126 that are inserted into the corresponding mounting holes on the host circuit board 122 in order to secure the jack on the circuit board.

When combined together, both parts 102 and 104 jointly form the front face of the connector jack, with its characteristic cavity 114, which is sized and shaped to mate with a standard male plug (not shown). Located within the cavity are contacts 116. These contacts are spring contacts for biased engagement with the male plug.

Contacts 116 extend into the internal chamber 118 of the part 102. This chamber may contain signal conditioning components, ESD protection components, power-over-Ethernet circuitry, and even the data processing components such as a microcontroller, Ethernet controller, data memory and the like. Detailed contents of the chamber 118 are irrelevant to the essence of the present invention and are not further mentioned. The presence of the chamber 118 is also optional. It should be noted and understood that connector jacks with and without the internal chamber are not going beyond the scope of the present invention.

Extending down from the chamber 118 are electric pins 120. These pins electrically connect the jack to the host circuit board 122. In the preferred embodiment of the present invention, pins 120 are shaped for through-hole mounting into the host circuit board 122. It is contemplated, however, that pins for surface mounting to the host circuit board 122 can be used without deviating from the spirit and the scope of the present invention.

Electrical shield 128, which is stamped out of thin metal, is formed to envelope the parts 102 and 104. FIG. 2 shows the shield 128 separated from the rest of the jack, while FIG. 3 shows the same shield assembled together with the parts 102 and 104.

The shield 128 has two solder tails 130, which are soldered into the host circuit board 122. This not only additionally secures the jack 100 on the host circuit board 122, but also tightens the internal assembly of the jack by pressing together the parts 102 and 104. The shield 128 only partially covers the front of the jack and leaves the front face 106 of the part 104 exposed.

When the jack 100 is installed on the host circuit board 122, the area on the circuit board located under the recess 124 is available for mounting other electronic components.

Notably, such electronic components include status indicator 132. Since the part 104 is made of transparent or translucent material, the status indicator 132 is visible from the outside through the front face 106 of the part 104. Taking into the account miniature dimensions of modern light-emitting devices, such as LEDs, it becomes apparent that several status indicators 132 can be mounted under the recess area 124, thus achieving one of the objects of the present invention.

Additionally, other electronic components, such as an IC chip 134 can also be mounted on the host circuit board 122 and at least partially within the recess area 124. In this way, the surface area of the host circuit board 122 is more densely populated and another object of the invention is achieved.

Figure 4:
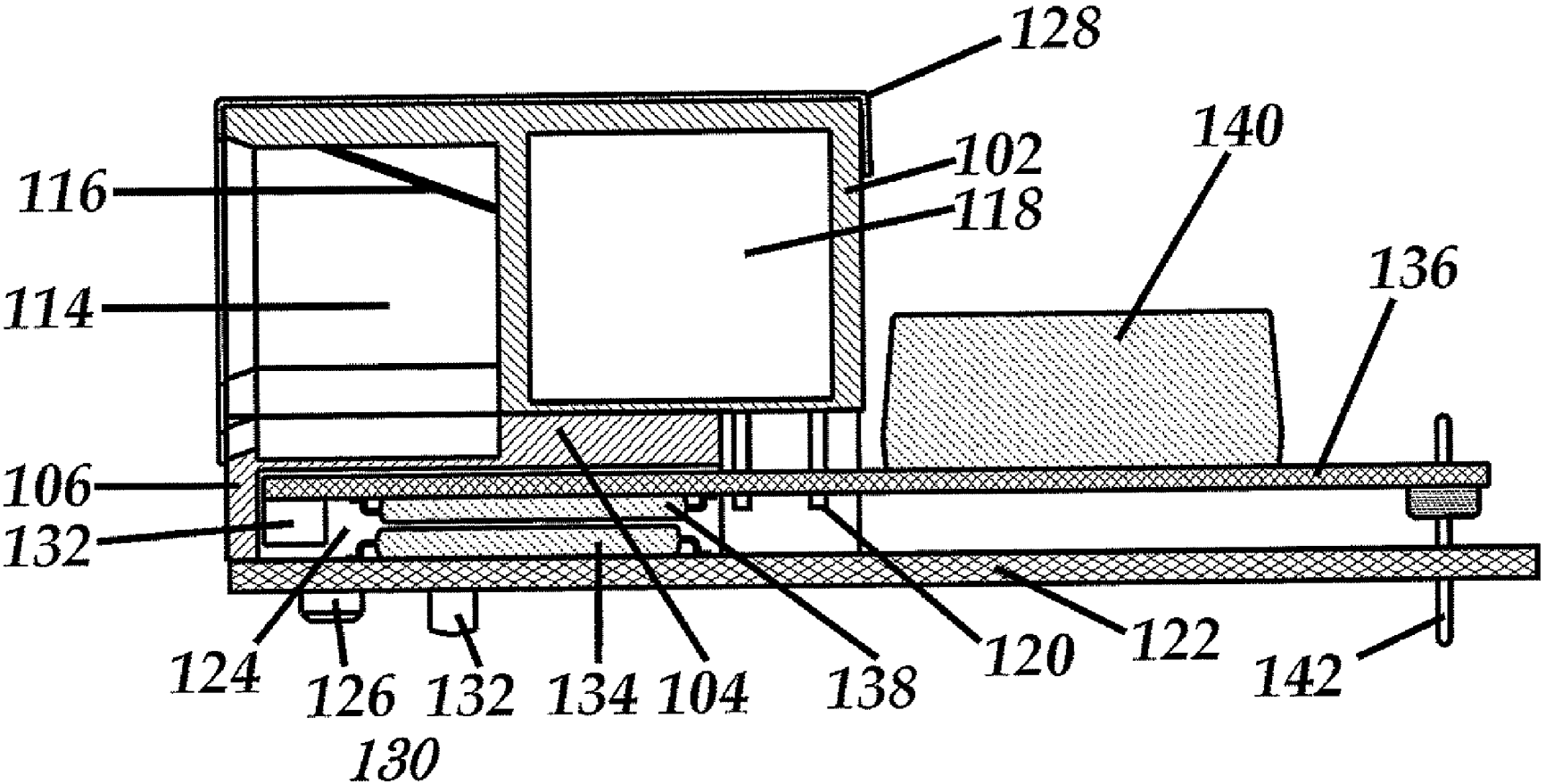
FIG. 4 is a cross-sectional view of a connector jack according to a second preferred embodiment of the present invention, a host circuit board with an IC chip installed on this host circuit board, and an additional circuit board with a status indicator and IC chips installed on this additional circuit board.

Looking now particularly at FIG. 4, there shown a cross-sectional view of the connector jack according to a second preferred embodiment of the present invention, a host circuit board with an IC chip installed on this host circuit board, and an additional circuit board with a status indicator and a IC chips installed on this additional circuit board.

In the alternative embodiment of the present invention, electric pins 120 do not extend into the host circuit board 122. In the alternative embodiment of the invention, electric pins 120 extend into the additional circuit board 136. The additional circuit board 136 resides, at least partially, within the recess area 124.

The additional circuit board 136 may have a number of status indicators 132 mounted on the surface thereof. Since the part 104 is made of transparent or translucent material, the status indicators 132 are visible from the outside through the front face 106 of the part 104. Taking into the account miniature dimensions of modern light-emitting devices, such as LEDs, it becomes apparent that several status indicators 132 can be mounted on the additional circuit board 136 within the recess area 124.

Other electronic components, such as an IC chip 138 can also be mounted on the additional circuit board 136 and at least partially within the recess area 124. It is also contemplated that the additional circuit board 136 may have a large size and extends significantly behind the parts 102 and 104. Still more electronic components, such as an IC chip 138 can be mounted on either or both sides of the additional circuit board 136. Such electronic components may include signal conditioning components, ESD protection components, power-over-Ethernet circuitry, and even the data processing components such as a microcontroller, Ethernet controller, data memory and the like.

Electrical contact between the additional circuit board 136 and the host circuit board 122 is running through a plurality of pins 142. In this embodiment, the pins 142 are shaped for through-hole mounting to the host circuit board 122. It is contemplated, however, that pins for surface mounting to the host circuit board 122 can be used without deviating from the spirit and the scope of the present invention.

Figure 5:
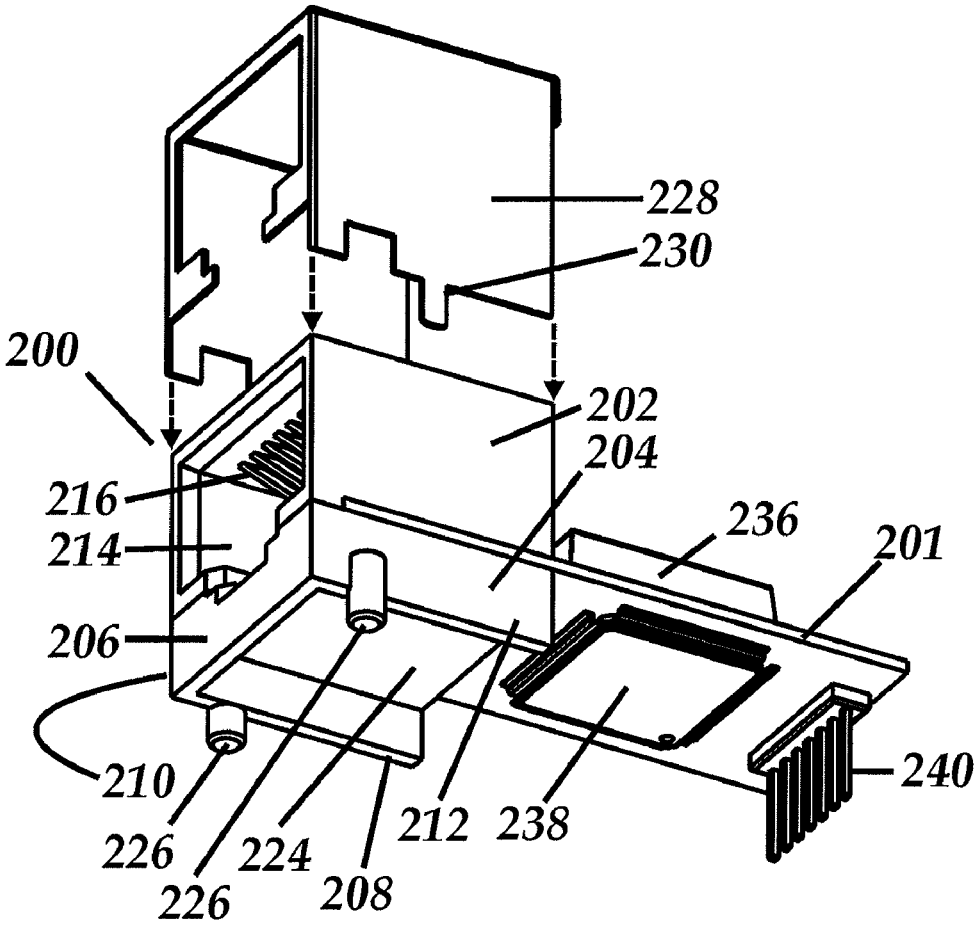
FIG. 5 is a perspective view of a connector jack assembly according to a third preferred embodiment of the present invention with the shield separated from the rest of the assembly.
Figure 6:
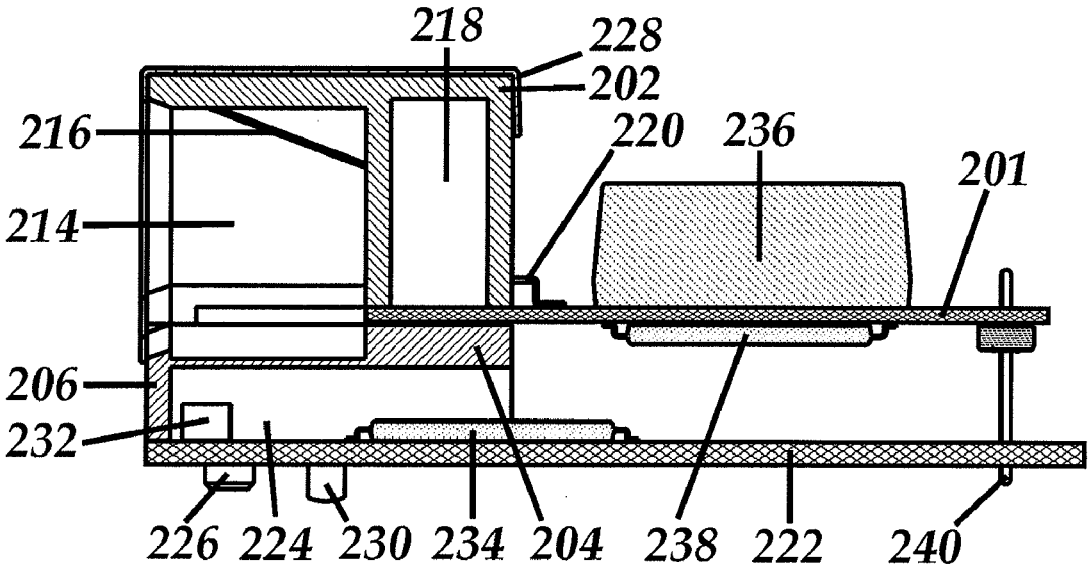
FIG. 6 is a cross-sectional view of a connector jack assembly according to the third preferred embodiment of the present invention, and a host circuit board with a status indicator and an IC chip installed on this host circuit board.

Referring particularly to FIGS. 5 and 6, there shown a third preferred embodiment of the present invention. FIG. 5 is a perspective view of a connector jack assembly according to the third preferred embodiment of the present invention with the shield separated from the rest of the assembly. FIG. 6 is a cross-sectional view of a connector jack assembly according to the third preferred embodiment of the present invention, and a host circuit board with a status indicator and an IC chip installed on this host circuit board.

As shown in FIGS. 5 and 6, the connector assembly 200 includes a circuit board 201 defining a top and a bottom surfaces, as well as two dielectric parts 202 and 204. The part 202 is mounted upon the top surface of the circuit board 201. The part 204 is mounted upon the bottom surface of the circuit board 201. It should be understood that the terms top and bottom are used here for clarity and should not be construed as limiting the scope of the present invention in any way.

Dielectric part 202 is formed from any suitable material conventionally used in the manufacture of RJ jacks, such as an appropriate mixture of the ABS and PC plastics. It should be noted that the part 202 is shown herein in a simplified form and, in fact, may consist of several separately molded parts. Such details are irrelevant to the essence of the present invention and not shown herein for clarity.

Dielectric part 204 is formed from any suitable transparent or translucent material, such as ABS. The part 204 defines a generally rectangular outline shape that characteristically includes a front face 206, bottom face 208, a left face 210, and a right face 212. Furthermore, the bottom face 208 defines a generally rectangular recess area 224 formed by wall extensions of the front face 206, the left face 210, and the right face 212. The footprint of the connector jack assembly 200 on the host circuit board 222 is then effectively defined by the area occupied by the three thin walls.

Additionally, the part 204 features two mounting pins 226 that are inserted into the corresponding mounting holes on the host circuit board 222 in order to secure the connector jack assembly 200 on the host circuit board.

When mounted on the circuit board 201, parts 202 and 204 jointly form the front face of the connector jack, with its characteristic cavity 214, which is sized and shaped to mate with a standard male plug (not shown). T he major portion of the cavity 214 resides within the part 202, while the locking shoulders characteristic to RJ connectors reside within the part 204. Located within the cavity 214 are contacts 216. These contacts are spring contacts for biased engagement with the male plug.

Contacts 216 extend into the internal chamber 218 of the part 202. This chamber may contain signal conditioning components, ESD protection components, power-over-Ethernet circuitry, and even the data processing components such as a microcontroller, Ethernet controller, data memory and the like. Detailed contents of the chamber 218 are irrelevant to the essence of the present invention and are not shown herein. T he presence of the chamber is also optional. It should be noted and understood that connector jack assemblies with and without the internal chamber are not going beyond the scope of the present invention.

Extending out of the chamber 218 are electric pins 220. These pins are connected to the circuit board 201. In the present invention, the pins 220 are shaped for surface mounting into the circuit board 201. It is contemplated, however, that pins for through-hole mounting to the circuit board 201 can be used without deviating from the spirit and the scope of the present invention.

Electrical shield 228, which is stamped out of thin metal, is formed to envelope the parts 202 and 204. FIG. 5 shows the shield 228 separately from the rest of the connector jack assembly, while FIG. 6 shows the same shield assembled together with the parts 202, 204 and the circuit board 201.

The shield 228 has two solder tails 230, which are soldered into the host circuit board 222. This not only additionally secures the connector jack assembly 200 on the host circuit board 222, but also tightens the connector jack assembly 200 by pressing together the parts 202 and 204, as well as the circuit board 201. The shield 228 only partially covers the front of the jack and leaves the front face 206 of the dielectric part 204 exposed.

The circuit board 201 extends behind the parts 202 and 204 and may contain any required components such as signal conditioning components, ESD protection components, power-over-Ethernet circuitry, and even the data processing components such as a microcontroller, Ethernet controller, data memory and the like. As an example, FIGS. 5 and 6 show the IC chips 236 and 238 installed on the opposite sides of the circuit board 201.

When the connector jack assembly 200 is installed on the host circuit board 222, the area on the circuit board located under the recess 224 is available for mounting other electronic components.

Notably, such electronic components include status indicator 232. Since the part 204 is made of transparent or translucent material, the status indicator 232 is visible from the outside through the front face 206 of the part 204. Taking into the account miniature dimensions of modern light-emitting devices, such as LEDs, it becomes apparent that several status indicators 232 can be mounted under the recess area 224, thus achieving one of the objects of the present invention.

Additionally, other electronic components, such as an IC chip 234 can also be mounted on the host circuit board 222 and at least partially within the recess area 224. In this way, the surface area of the host circuit board 222 is more densely populated and another object of the invention is achieved.

Electrical contact between the circuit board 201 and the host circuit board 222 is through a plurality of pins 240. In the third embodiment of the present invention, pins 240 are shaped for through-hole mounting to the host circuit board 222. It is contemplated, however, that pins for surface mounting to the host circuit board 222 can be used without deviating from the spirit and the scope of the present invention.

Figure 7:
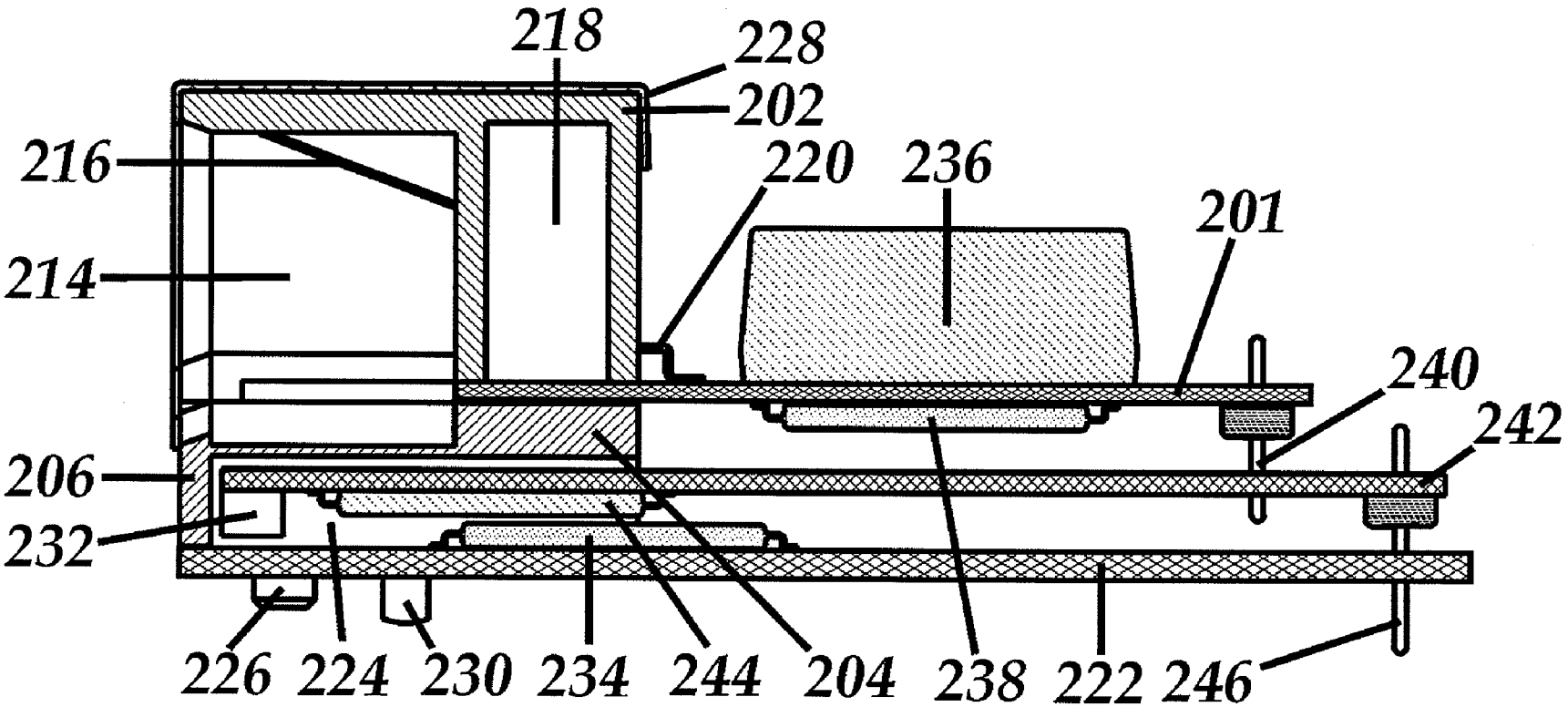
FIG. 7 is a cross-sectional view of a connector jack assembly according to a fourth preferred embodiment of the present invention, a host circuit board with an IC chip installed on this host circuit board, and an additional circuit board with a status indicator and IC chips installed on this additional circuit board.

Looking now particularly at FIG. 7, there shown a cross-sectional view of a connector jack assembly according to a fourth preferred embodiment of the present invention, a host circuit board with an IC chip installed on this host circuit board, and an additional circuit board with a status indicator and IC chips installed on this additional circuit board.

In the fourth preferred embodiment of the present invention, the electric pins 240 do not extend into the host circuit board 222, but into the additional circuit board 242. The additional circuit board 242 resides, at least partially, within the recess area 224 of the part 204 of the connector jack assembly. In the fourth embodiment of the present invention, the pins 240 are shaped for through-hole mounting to the additional circuit board 242. It is contemplated, however, that pins for through-hole mounting to the additional circuit board 242 can be used without deviating from the spirit and the scope of the present invention.

The additional circuit board 242 may have a number of status indicators 232 mounted on the surface thereof. Since the part 204 is made of transparent or translucent material, the status indicators 232 are visible from the outside through the front face 206 of the part 204. Taking into the account miniature dimensions of modern light-emitting devices, such as LEDs, it becomes apparent that several status indicators 228 can be mounted on the additional circuit board 242 within the recess area 224.

Additionally, other electronic components, such as an IC chip 244 can also be mounted on the additional circuit board 242 and at least partially within the recess area 224.

It is also contemplated that the additional circuit board 242 may have a large size and may extend significantly behind the parts 202 and 204. Still more electronic components can be mounted on either or both sides of the additional circuit board 242. Such electronic components may include signal conditioning components, ESD protection components, power-over-Ethernet circuitry, and even the data processing components such as a microcontroller, Ethernet controller, data memory and the like.

Electrical contact between the additional circuit board 242 and the host circuit board 222 is through a plurality of pins 246. In the fourth embodiment of the present invention, the pins 246 are shaped for through-hole mounting to the host circuit board 222. It is contemplated, however, that pins for surface mounting to the host circuit board 222 can be used without deviating from the spirit and the scope of the present invention.

Based upon the above, the present invention provides a connector jack with reduced effective host PCB footprint, which allows for integrating more functional elements within the jack.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A connector jack assembly comprising:

a circuit board defining a first and second opposing sides;

a first part mounted upon the first side of the circuit board;

a second part made of a transparent or translucent material and mounted upon the second side of the circuit board;

the first and the second parts jointly forming a front face of the connector jack assembly, the front face having a plug receiving cavity on the surface thereof, and with a plurality of electrical contacts positioned within the plug receiving cavity; and the second part defining a bottom face having a recess area on the surface thereof and adapted for mounting on a host circuit board.

2. The connector jack assembly of claim 1, where the recess area occupies a substantial portion of the bottom face and allows for mounting additional components on the host circuit board at least partially within the recess area.

3. The connector jack assembly of claim 2, where the additional components include one or more status indicators.

4. The connector jack assembly of claim 2, further comprising a plurality of pins electrically coupled to the electrical contacts and the circuit board.

5. The connector jack assembly of claim 4, further comprising a plurality of additional pins mounted upon the circuit board and connecting the circuit board to an additional circuit board, the additional circuit board is at least partially residing in the recess area.

6. The connector jack assembly of claim 5, where the additional circuit board includes one or more status indicators mounted on the surface thereof.

7. A fabrication method for a connector jack assembly comprising the steps of:

providing a circuit board defining a first and second opposing sides;

mounting a first part upon the first side of the circuit board;

where the first part defines a portion of a plug receiving cavity, and where a plurality of electric contacts is positioned within the portion of the plug receiving cavity; and mounting a second part upon the second side of the circuit board, where the second part is formed from a transparent or translucent material, and defines:

a further portion of the plug receiving cavity; and a bottom face having a recess area on the surface thereof and adapted for mounting on a host circuit board, the recess area occupying a substantial portion of the bottom face and allowing for placing additional components on the host circuit board at least partially within the recess area.

8. The fabrication method of claim 7, further comprising a step of providing the first part with a plurality of pins, the pins electrically coupled to the electrical contacts and the circuit board.

9. The fabrication method of claim 8, further comprising a step of adding a plurality of additional pins which are mounted on the circuit board and for electrically connecting the connector jack assembly to the host circuit board.

10. The fabrication method of claim 8, further comprising a step of adding a plurality of additional pins which are mounted on the circuit board and for electrically connecting the connector jack assembly to an additional circuit board.

* * * * *